United States Patent [19]

Shishido et al.

[11] 4,242,652

[45] Dec. 30, 1980

[54] FOUR PORT WAVEGUIDE SWITCH

[75] Inventors: Tsuneo Shishido, Rancho Palos Verdes; Philip A. Eyermann, Lawndale; William L. Vick, Yorba Linda; Herman W. Cramm, Rolling Hills Estates, all of Calif.

[73] Assignee: Hughes Aircraft Company, Culver City, Calif.

[21] Appl. No.: 922,895

[22] Filed: Jul. 10, 1978

[51] Int. Cl.[2] ..... H01P 1/10

[52] U.S. Cl. ..... 333/106; 333/108

[58] Field of Search ..... 333/101, 105–108, 333/259

[56] References Cited

U.S. PATENT DOCUMENTS 4,151,489 4/1979 Berman et al. ..... 333/103

*Primary Examiner*—Paul L. Gensler

*Attorney, Agent, or Firm*—William H. MacAllister; John Holtrichter, Jr.

[57] ABSTRACT

A waveguide switch having four RF ports in coplanar relationship and incorporating four waveguide transmission lines in a single rotating mechanism on two levels, the rotating mechanism being driven by an electromagnetic stopper motor or the like to efficiently function as a multiple redundant waveguide switch.

5 Claims, 9 Drawing Figures

FOUR PORT WAVEGUIDE SWITCH

BACKGROUND OF THE INVENTION

The background of the invention will be set forth in two parts.

FIELD OF THE INVENTION

This invention relates to microwave devices and more particularly to waveguide switches.

DESCRIPTION OF THE PRIOR ART

Waveguide switches have been known and available for quite some time and are either manually operated or provided with remotely controlled (electromechanical) actuating mechanisms such as motors and rotary or linear solenoids. These waveguide switches generally include a housing incorporating a stator portion and a rotor portion in which one or more waveguide channels are provided. The housing or stator includes appropriate flange connections at the port locations. The rotor can then either be manually or remotely rotated within the stator housing and, depending on the rotor position, the various waveguides connected to the stator flange connections are linked to each other. Electrical continuity between the rotor and stator portions of the switch is generally achieved by means of quarter wave chokes providing high isolation between the rotor waveguide chanels.

In most ground-based installations, the prior art waveguide switches fulfill their design function. However, in spacecraft applications where space and weight must be kept to an absolute minimum, presently known waveguide switches cannot be used without adding weight, bulk, and complexity to the system. For example, it is essential to provide back-up capability in a spacecraft system for most active devices such as traveling wave tubes and other active repeater elements, for example, since the loss of even a single device could completely close down an important channel of communications. Accordingly, in almost all spacecraft systems, a redundancy capability is incorporated so that a dead or failing device can be bypassed, either automatically or by ground terminal command.

In some redundancy schemes, a spare device is provided for every two active devices so that if either active device fails, the spare may be switched into the circuits. Using presently known waveguide switches, the redundancy circuit required to accomplish this task would include at least two conventional four port waveguide switches for the input circuit and a similar number in the output circuit, along with additional waveguide interconnections which will all introduce additional losses to the system.

An even more desirable redundancy system would be one that is capable of switching any spare or not-then-used active device into any needed channel position. Using prior art waveguide switches to accomplish this scheme would lead to a prohibitively heavy, complicated, and lossy system. It should therefore be evident that a new waveguide switch which will implement the highly advantageous redundancy systems noted above, but which will require fewer waveguide switches and interconnecting waveguides, and thus lessen the complexity, bulk and RF losses inherent in prior art systems, would constitute a significant advancement of the art.

SUMMARY OF THE INVENTION

In view of the foregoing functions and conditions characteristic of the prior art, it is a primary object of the present invention to provide new and improved four port waveguide switches.

Another object of the present invention is to provide in a redundancy system a lighter weight and less bulky waveguide switch circuit that reduces transmission line losses.

Still another object of the present invention is to provide a waveguide switch that enables the remote selection of an active device to replace any other active device in a system.

Yet, another object of the present invention is to provide a four port waveguide switch wherein the ports are coplanar and the waveguide channels in the rotor thereof are on two levels.

In accordance with an embodiment of the present invention, a four port waveguide switch includes a housing having a rotor-accepting cavity and first, second, third, and fourth ports disposed therein. A rotor having first and second channels is disposed in the cavity, the channels defining first and second orthogonal radio frequency propagation paths respectively between the first and third ports and between the second and fourth ports when the rotor is in its first rotor position. The rotor also includes third and fourth oppositely curved channels defining third and fourth curved radio frequency propagation paths respectively between the first and second ports and between the third and fourth ports when the rotor is in its second rotor position. The third and fourth curved paths also define fifth and sixth radio frequency propagation paths respectively between the first and fourth ports and between the second and third ports when the rotor is in its third rotor position. The invention also includes rotating means operatively coupled to the rotor for selectively moving the rotor for selectively moving the rotor to any of its three positions.

The features of the present invention which are believed to be novel are set forth with particularity in the appended claims. The present invention, both as to its organization and manner of operation, together with further object and advantages thereof, may best be understood by making reference to the following description taken in conjunction with the accompanying drawing in which like reference characters refer to like elements in the several views.

DESCRIPTION OF THE PREFERRED EMBODIMENTS

Figure 1:
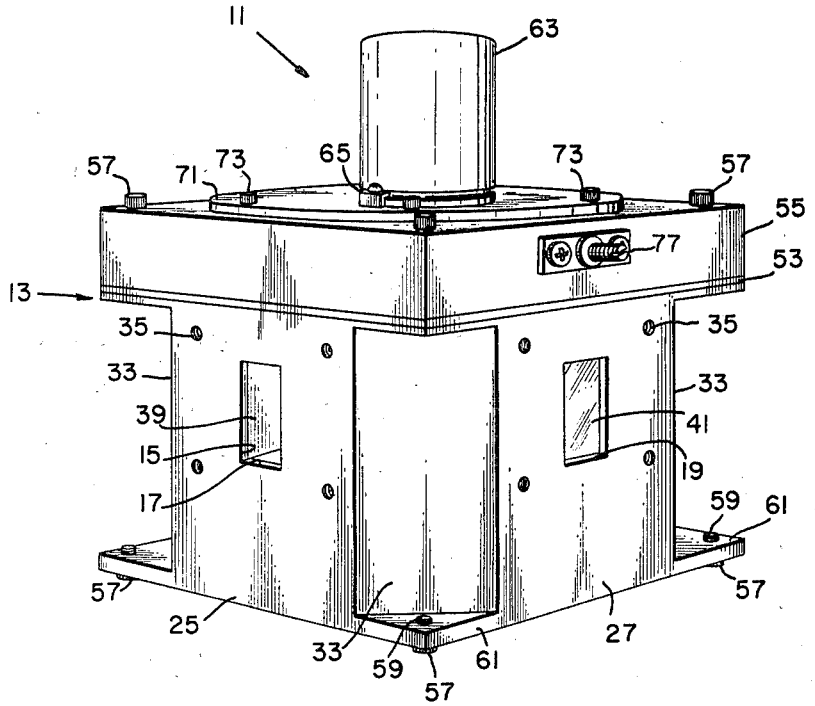
FIG. 1 is a perspective view of a four port waveguide switch constructed in accordance with an embodiment of the present invention.
Figure 2:
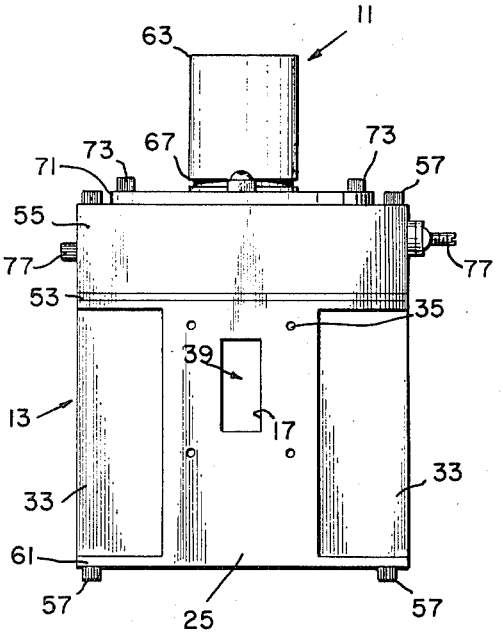
FIG. 2 is a front elevational view of the waveguide switch of FIG. 1.
Figure 3:
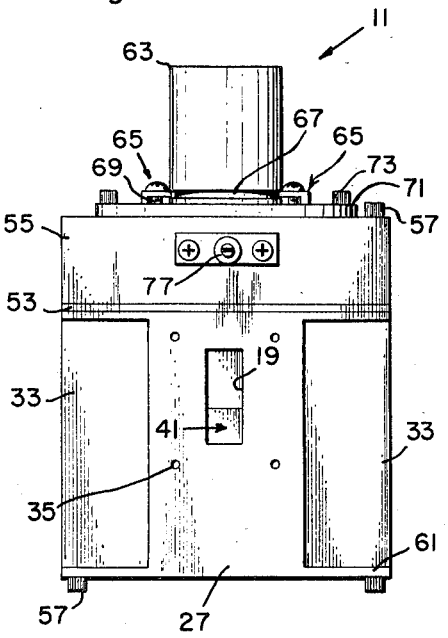
FIG. 3 is a right side elevational view of the waveguide switch shown in FIG. 1.

Referrng now to the drawings and more particularly to FIGS. 1–5, there is shown a four port waveguide switch 11 with a machined aluminum housing 13 having a rotor-accepting cylindrical cavity 15 and first, second, third and fourth ports 17, 19, 21, 23 disposed therein. The four ports are respectively located in a front face 25, a right face 27, a rear face 29, and a left face 31 of the housing, the angular faces 33 of the housing being provided to eliminate all unnecessary metal for weight considerations. Conventional waveguide connecting flanges (not shown) are easily attached to the housing 13 at appropriate port locations by the use of machine screws engaged in the tapped holes 35 adjacent each of the ports.

Figure 6:
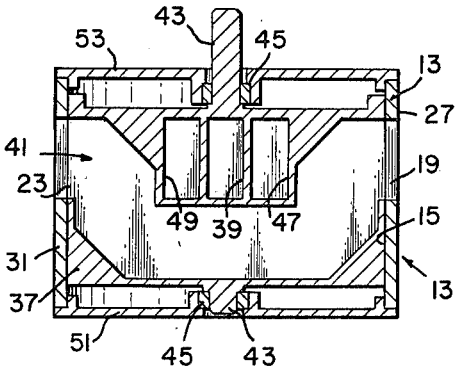
FIG. 6 is a sectional view, reduced in size, of the waveguide switch of FIG. 1 showing the two levels of energy propagating channels in the rotor.

Each of the ports communicate with the cylindrical cavity 15, and a rotor 37 having first and second channels 39 and 41 (defining first and second orthogonal radio frequency propagating paths) is rotatably disposed within the cavity 15 with shaft 43 supported by conventional bearings 45, as seen in FIG. 6. These orthogonal paths allow propagation of RF energy, having a wavelength appropriate for the dimension of the ports and waveguide channels, respectively between the first and third ports 17 and 21, and between the second and fourth ports 19 and 23 when the rotor 37 is in its first or center rotor position as illustrated in FIGS. 1–3, 6, and 7.

Figure 4:
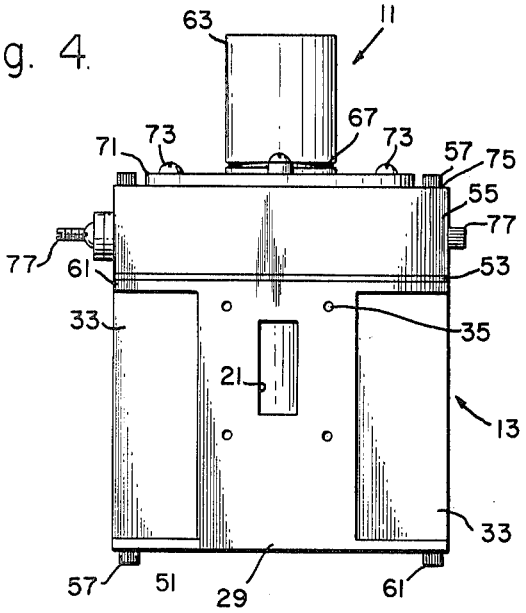
FIG. 4 is a rear elevational view of the waveguide switch of FIG. 1.
Figure 5:
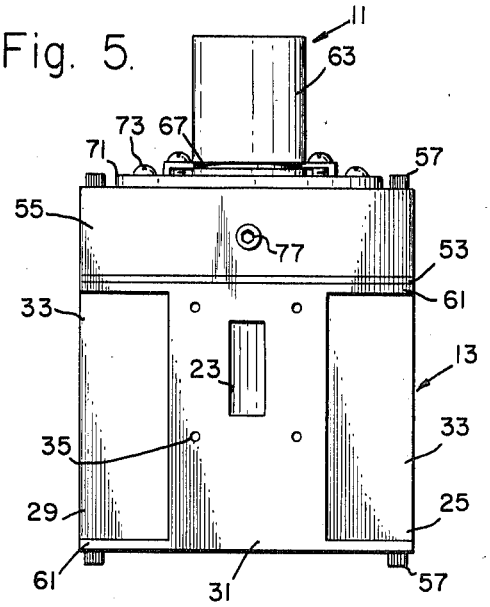
FIG. 5 is a left side elevational view of the waveguide switch shown in FIG. 1.
Figure 9:
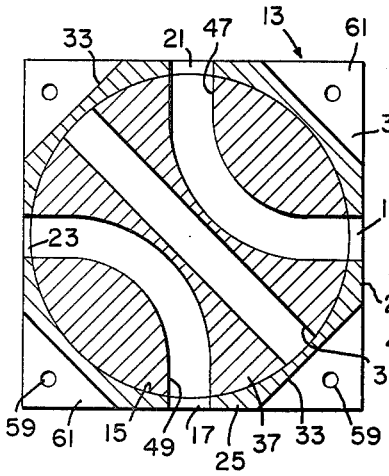
FIGS. 7–9 are sectional representations showing the rotor in its three positions relative to the stator or housing in accordance with the present invention.
Figure 7:
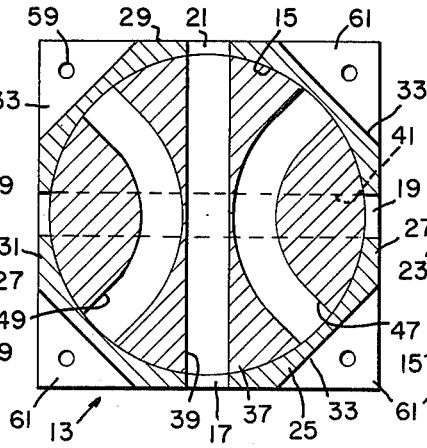
Figure 8:
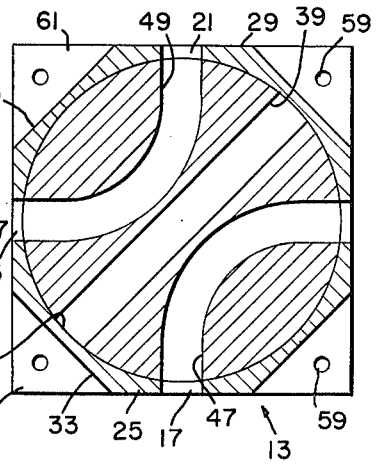

The rotor 37 also includes therein a third curved channel 47 defining a third curved RF propagation path, and a fourth curved channel 49 defining an oppositely curved fourth path, respectively between the first and second ports 17 and 19, and between the third and fourth ports 21 and 23, when the rotor is in its second rotor position illustrated in FIGS. 5 and 8. The third and fourth curved channels 47 and 49 also provide an RF propagation path between the first and fourth ports 17 and 23 and between the second and third ports 19 and 21, respectively, when the rotor is in its third rotor position as shown in FIGS. 4 and 9.

The cylindrical cavity 15 may be machined completely through the housing 13 and a bottom plate 51 and an upper plate 53, with a rotor assembly member 55 attached by screws 57 to tapped holes 59 in flanges 61 extending outwardly from the housing at the angular faces 33. A conventional stepper motor 63 is mounted by any suitable means such as right angle bracket and screw assemblies 65 registering in an annular groove 67 in the motor case and seated in appropriately tapped holes 69 in a cover plate 71 attached by screws 73 to the upper surface 75 of the motor assembly member 55. Conventional detent members and rotation stop members may be employed (such as screws 77) in order to help in positively registering the rotor 37 relative to its three rotor positions. The stepper motor is of course connected by wires to an appropriate source of control current, as is well known in the art, in order to selectably provide the three rotor positions shown in FIGS. 7–9, for example.

One of the major features of the invention is the provision of the non-intersecting orthogonal channels 39 and 41, which simultaneously connect two separate RF signal paths when the rotor 37 is in its first rotor position. This is accomplished by making the first channel 39 a straight-through opening, while making the second channel 41 curve below and about the first channel, as best illustrated in FIG. 6. This provision of a two-level path configuration allows all the ports to be coplanar.

From the foregoing it should be evident that there has herein been described a four port waveguide switch having a single rotor with four channels communicating with four coplanar ports in the switch housing. This switch provides a cross connection for two RF signals to be connected simultaneously, where the rotor has a center or zero reference location or position and two opposite 45 degree positions from the reference. The invention has been found to maintain high isolation of greater than 50 dB between channels, with low RF insertion loss and low VSWR.

What is claimed is:

1. A four part waveguide switch comprising: a housing having a rotor-accepting cavity and first, second, third and fourth ports disposed therein;

a rotor disposed in said cavity and having first and second channels therein defining first and second orthogonal radio frequency propagation paths respectively between said first and third ports and between said second and fourth ports when said rotor is in its first rotor position, said rotor also including third and fourth oppositely curved channels defining third and fourth curved radio frequency propagation paths respectively between said first and second ports and between said third and fourth ports when said rotor is in its second rotor position, said third and fourth curved paths also defining fifth and sixth radio frequency propagation paths respectively between said first and fourth ports and between said second and third ports when said rotor is in its third rotor position; and rotating means operatively coupled to said rotor for selectively moving said rotor to any of its three positions.

2. The waveguide switch according to claim 1, wherein said first and second channels lie in respective first and second orthogonal planes.

3. The waveguide switch according to claim 1, wherein said first channel lies along a first axis and said second channel lies in a plane orthogonal to said first axis and includes a curved portion defining a curved path segment about said first channel.

4. The waveguide switch according to claim 1, wherein said first and third ports and said second and fourth ports are respectively located opposite each other in said housing.

5. The waveguide switch according to claim 1, wherein said rotating means includes a stepping motor.

* * * * *